US006094945A

United States Patent [19]

Lonati et al.

[11] Patent Number: 6,094,945

[45] Date of Patent: Aug. 1, 2000

[54] DEVICE FOR FEEDING AN ELASTICALLY EXTENDABLE YARN TO HOSIERY KNITTING MACHINES

[75] Inventors: Francesco Lonati; Ettore Lonati; Fausto Lonati; Tiberio Lonati, all of Brescia, Italy

[73] Assignee: Santoni S.p.A., Brescia, Italy

[21] Appl. No.: 09/024,267

[22] Filed: Feb. 17, 1998

[51] Int. Cl.[7] ..... D04B 15/50

[52] U.S. Cl. ..... 66/146; 66/132 R; 139/194; 226/30; 226/181; 226/45

[58] Field of Search ..... 139/194; 66/146, 66/132 R; 226/30, 181, 42, 45

[56] References Cited

U.S. PATENT DOCUMENTS

| | | | |
|---|---|---|---|
| 3,677,036 | 7/1972 | Hatay | 66/132 R |
| 4,625,528 | 12/1986 | Damau Guell | 66/132 R |
| 4,645,109 | 2/1987 | Fleissner | 226/42 R |
| 4,662,407 | 5/1987 | Duncan | 139/110 |
| 5,381,676 | 1/1995 | Shibata et al. | 66/149 R |

FOREIGN PATENT DOCUMENTS

| | | |
|---|---|---|
| 30 02 311 | 7/1981 | Germany . |
| 42 06 607 | 4/1993 | Germany . |
| 195 37 325 | 11/1996 | Germany . |
| 195 37 215 | 4/1997 | Germany . |
| 86 06765 | 11/1986 | WIPO . |
| 88 08893 | 11/1988 | WIPO . |

*Primary Examiner*—Andy Falik
*Attorney, Agent, or Firm*—Guido Modiano; Albert Josif

[57] ABSTRACT

A device for feeding an elastically extendable yarn to hosiery knitting machines, which includes a positive yarn feeder composed of two mutually opposite contrarotating rollers which have parallel axes and between which the yarn to be fed passes. Elements are provided for rotationally actuating at least one of the rollers about its own axis with a rotation rate which can vary on command. Downstream of the positive feeder along the yarn feed direction, there are arranged elements for detecting the tension of the yarn and a programmable control and monitoring unit which is operatively connected to the detector elements. The control and monitoring unit compares the yarn tension detected by the detector elements with a yarn tension which is preset in the control and monitoring unit. The control and monitoring unit is also operatively connected to the rotary actuation means in order to vary the rotation rate of the roller of the positive feeder in order to maintain within a preset tolerance range the difference between the detected yarn tension and the preset yarn tension.

15 Claims, 2 Drawing Sheets

DEVICE FOR FEEDING AN ELASTICALLY EXTENDABLE YARN TO HOSIERY KNITTING MACHINES

BACKGROUND OF THE INVENTION

The present invention relates to a device for feeding an elastically extendable yarn to hosiery knitting machines.

Devices for feeding an elastically extendable yarn to hosiery knitting machines are known.

One of these devices is composed of a yarn accumulation device, which is substantially constituted by a drum which is driven, so that it rotates about its own axis, by a variable-speed electric motor. The yarn arriving from the reel is wound in each case on this drum and is then unwound to feed the hosiery knitting machine.

This device is generally provided with a load cell arranged along the path followed by the yarn between the drum of the yarn accumulation device and the hosiery knitting machine for detecting the tension of the yarn. The load cell is connected to a comparator circuit which is in turn connected to the electric motor that drives the drum, so as to vary the rotation rate of the drum when the actual tension of the yarn that unwinds from the drum is different from a preset tension value, so as to bring the actual tension of the yarn to the preset value.

This device, installed in circular hosiery knitting machines, allows to produce tubular items in which the tension of the elastic yarn is practically constant over the entire length.

This device, however, has the limitation that it does not allow to produce items in which the tension of the elastic yarn is differentiated in the various regions of the item; i.e., it does not allow to vary the tension of the yarn during the manufacture of the item.

These devices also entail the problem that it is not possible to produce a high level of tension when feeding yarns that have a relatively large diameter.

Devices are also known which are constituted by so-called "positive feeders", i.e., feeders composed of two mutually opposite and contrarotating rollers which have parallel axes and between which the yarn to be fed passes. At least one of the two rollers is driven so as to revolve about its own axis by means of a variable-speed electric motor which is actuated with a speed correlated to the operating speed of the machine, so as to ensure the intended tension of the elastic yarn during its feeding.

With these devices it is possible to produce items in which the degree of tension of the elastic yarn can vary during the production of the item by varying according to requirements the actuation speed of the electric motor.

However, these devices entail the problem that they cannot precisely ensure a given tension of the elastic yarn, since when the unwinding conditions of the reel of yarn sent to the positive feeder vary, the degree of tensioning of the yarn sent to the hosiery knitting machine varies undesirably.

SUMMARY OF THE INVENTION

The aim of the present invention is to solve the above problems by providing a device for feeding an elastically extendable yarn to hosiery knitting machines which is capable of ensuring high precision, as regards the tensioning of the fed yarn, even when the conditions for the unwinding of the yarn from the reel vary.

Within the scope of this aim, an object of the present invention is to provide a device that allows to manufacture items with a degree of elastic yarn tension that can vary during the production of said item.

Another object of the present invention is to provide a device which, when mounted on a hosiery knitting machine, allows to produce hosiery having a differentiated supporting effect in the various regions according to requirements.

Another object of the present invention is to provide a device which ensures high operating precision, regardless of the diameter of the elastic yarn being fed.

This aim, these objects, and others which will become apparent hereinafter are achieved by a device for feeding an elastically extendable yarn to hosiery knitting machines, comprising a positive yarn feeder composed of two mutually opposite contrarotating rollers which have parallel axes, between which a yarn to be fed passes, means being provided for rotationally actuating at least one of said rollers about its own axis with a rotation rate which can vary on command, characterized in that it comprises, downstream of said positive feeder along the yarn feed direction, detector means for detecting the tension of the yarn and a programmable control and monitoring unit which is operatively connected to said detector means and is suitable to compare the tension of the yarn detected by said detector means with a yarn tension which is preset in said control and monitoring unit, said control and monitoring unit being also operatively connected to said actuation means in order to vary the rotation rate of said at least one roller of the positive feeder in order to maintain within a preset tolerance range the difference between the detected yarn tension and the preset yarn tension.

BRIEF DESCRIPTION OF THE DRAWINGS

Further characteristics and advantages of the present invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
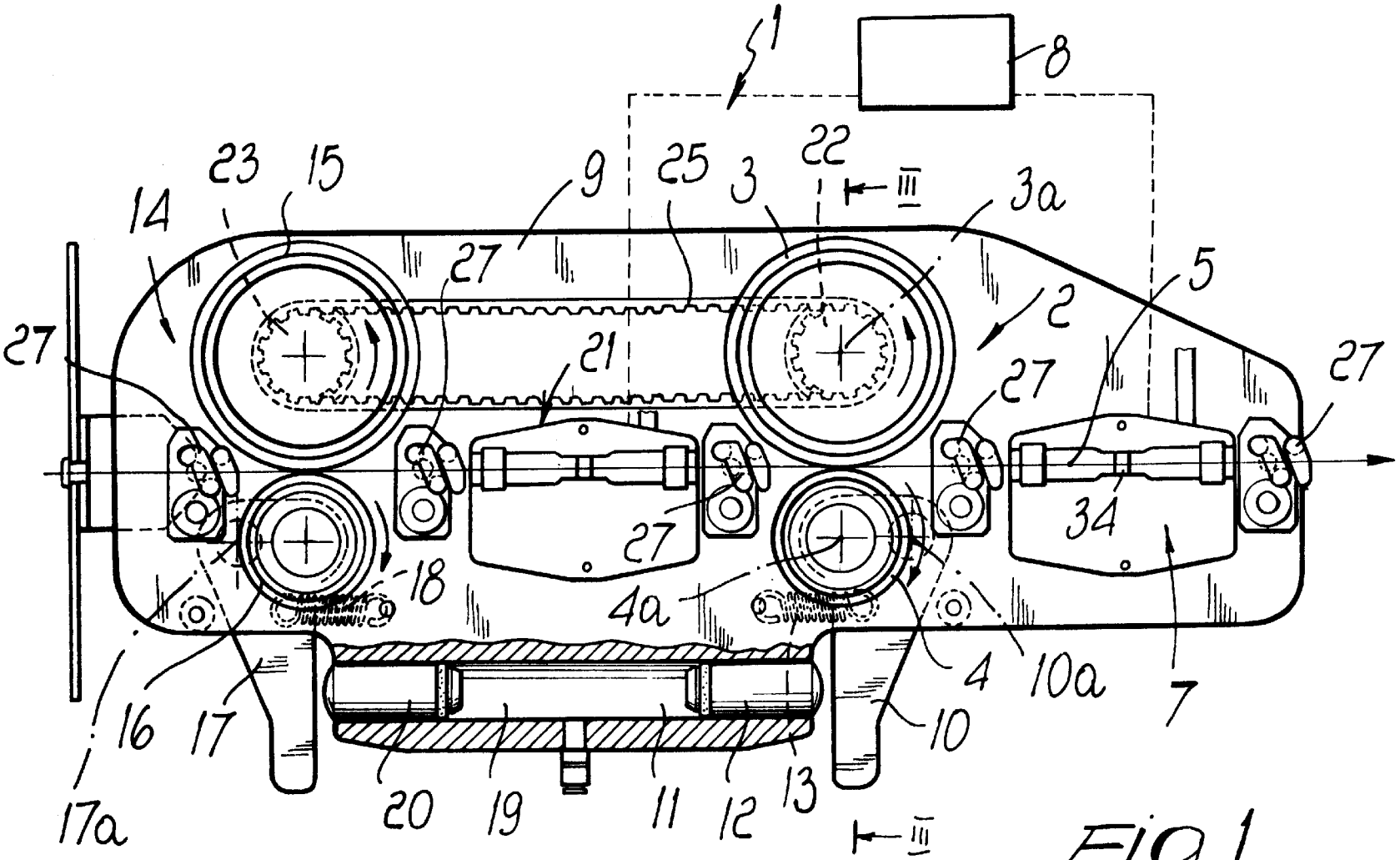
FIG. 1 is a schematic front elevation view of the device according to the present invention.
Figure 3:
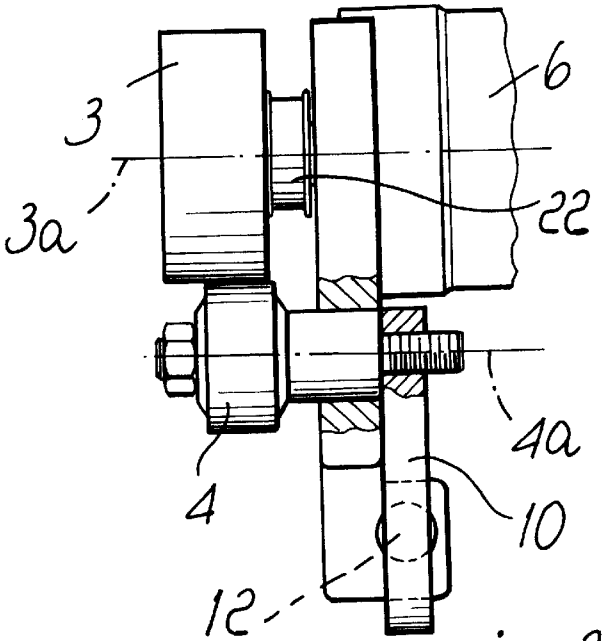
FIG. 3 is a sectional view of FIG. 1, taken along the plane III—III.
Figure 2:
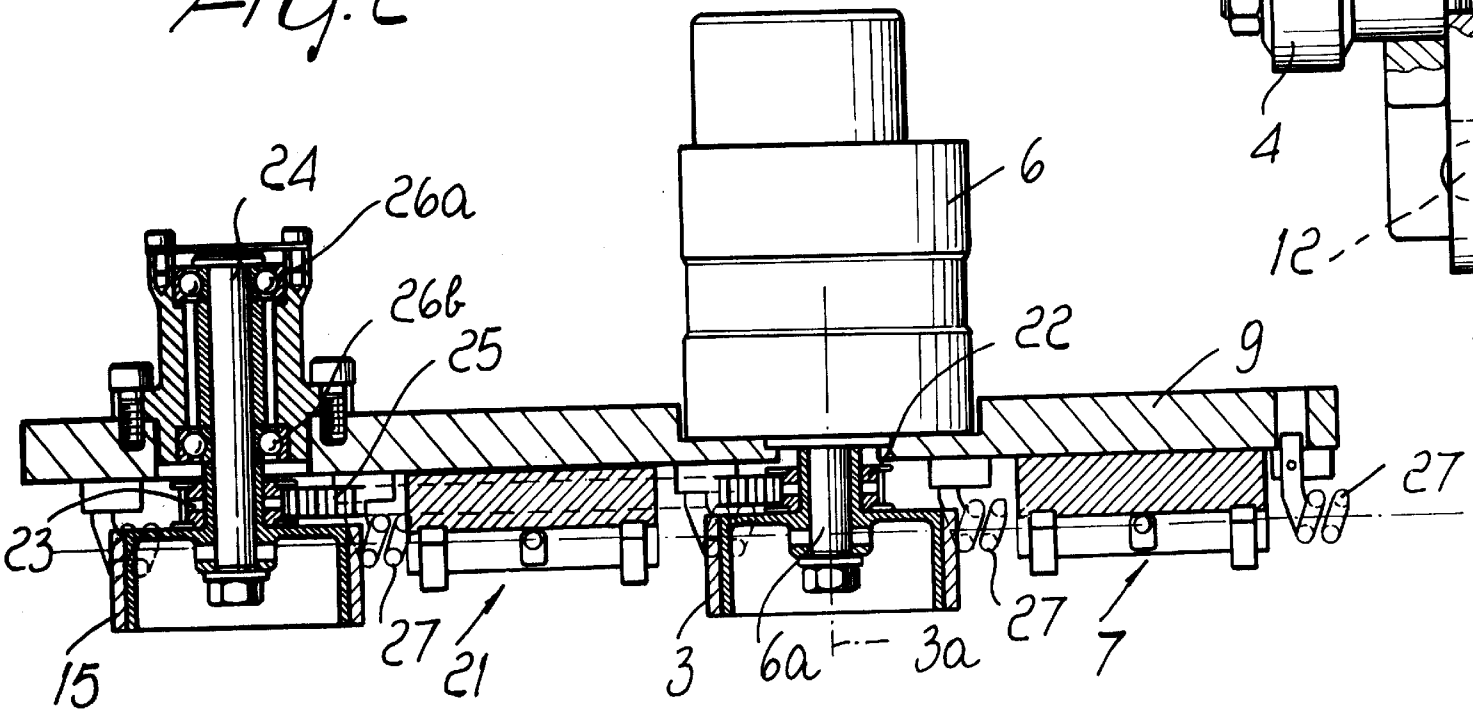
FIG. 2 is a partially sectional top plan view of the device according to the present invention.

With reference to the above figures, the device according to the present invention, generally designated by the reference numeral 1, comprises a positive feeder 2, which is composed of two mutually opposite and contrarotating rollers 3 and 4 which have parallel axes and between which the yarn 5 passes to be fed to the hosiery knitting machine, which is not shown for the sake of simplicity.

The device comprises means 6 for actuating at least one of the rollers 3 and 4 so that it revolves about its own axis and with a rotation rate that can be varied on command.

The device according to the invention comprises, downstream of the positive feeder 2 along the feed direction of the yarn 5, detector means 7 for detecting the tension of the yarn 5 and a programmable control and monitoring unit 8 which is operatively connected to the detector means 7 and is suitable to compare the yarn tension detected by the detector means 7 and a yarn tension which is preset in said control and monitoring unit 8. The control and monitoring unit 8 is also connected to the actuation means 6 in order to vary the rotation rate of at least one of the rollers 3 and 4 of the positive feeder 2 in order to maintain within a preset tolerance range the difference between the tension of the yarn 5 detected by the detector means 7 and the yarn tension that is preset in the control and monitoring unit 8.

More particularly, the positive feeder 2 comprises a driving roller 3 which is supported, so that it can revolve about its own axis 3*a*, by a supporting plate 9 and is connected to the actuation means 6.

The positive feeder 2 further comprises a presser roller 4 whose lateral surface is arranged adjacent to, and pushed against, the cylindrical surface of the driving roller 3.

The presser roller 4 is supported freely about its axis 4*a*, which is parallel to the axis 3*a*, by an arm 10 which is pivoted to the plate 9 about an axis 10*a* which is parallel to the axes 3*a* and 4*a*. The arm 10 can oscillate about the axis 10*a*, so as to allow to vary the distance of the presser roller 4 from the driving roller 3.

The oscillation of the arm 10 about the axis 10*a*, which moves the presser roller 4 away from the driving roller 3, can be produced by means of a conventional actuator, for example by means of a pneumatic cylinder 11 which is formed in the plate 9 and is provided with a piston 12 that acts on the arm 10. This oscillation is contrasted by a spring 13 which engages the plate 9 with one end and the arm 10 with the other end and elastically contrasts the movement of the presser roller 4 away from the driving roller 3, keeping the presser roller 4 against the driving roller 3 with a pressure produced by the preloading of said spring 13.

The actuation means 6 can be constituted by a variable-speed electric motor, such as for example a DC electric motor, an electric step motor, preferably a brushless motor the output shaft 6*a* whereof is rigidly connected to the driving roller 3.

The detector means 7 are preferably constituted by a conventional load cell, for example of the type provided with a feeler 34 which makes contact with the yarn 5 and is connected to a transducer, which converts the force applied by the yarn 5 to the feeler or probe 34 into an electrical signal which is sent to the control and monitoring unit 8.

The control and monitoring unit 8 is constituted by a programmable microprocessor, in which it is possible to preset various yarn tension values, which are meant to be then compared with the yarn tension detected by the detector means 7, as will become apparent hereinafter.

The control and monitoring unit 8 can also be connected to the hosiery knitting machine or rather to the control and monitoring unit that supervises the operation of the entire machine, so that the yarn tensions preset in the control and monitoring unit 8 are correlated to the various production steps of the machine.

The control and monitoring unit 8 can be constituted by a programmable microprocessor which is separate from the programmable microprocessor that supervises the operation of the hosiery knitting machine, or can be constituted by the programmable microprocessor of the hosiery knitting machine itself.

Advantageously, upstream of the positive feeder 2 in the direction along which the yarn 5 is fed to the hosiery knitting machine there is provided a second positive feeder, generally designated by the reference numeral 14. The positive feeder 14 can be substantially identical to the positive feeder 2, i.e., composed of a driving roller 15 and a presser roller 16 which is mounted on an arm 17 which is pivoted to the plate 9 about an axis 17*a*. The presser roller 16 is pushed against the driving roller 15 by a spring 18 which acts between the plate 9 and the arm 17, and the oscillation of the arm 17 to move the presser roller 16 away from the driving roller 15 can be actuated by means of a pneumatic cylinder 19 which acts on the arm 17 by means of its piston 20.

The driving roller 15 can be actuated by independent actuation means, constituted for example by a variable-speed electric motor, or by a step motor, preferably a brushless motor, or can be suitably connected kinematically to the driving roller 3 of the positive feeder 2 and thus be actuated by the same actuation means 6 used to actuate the positive feeder 2.

Second means 21 for detecting the tension of the yarn 5 between the two positive feeders 14 and 2 are interposed between the positive feeder 14 and the positive feeder 2.

The detector means 21 can be constituted, like the detector means 7, by a load cell which transmits to the control and monitoring unit 8 a signal which is proportional to the detected yarn tension.

The kinematic connection between the driving roller 15 of the positive feeder 14 and the driving roller 3 of the positive feeder 2 can be provided by keying a toothed pulley 22 to the shaft 6*a*, i.e., to the shaft of the driving roller 3, and a toothed pulley 23 on the shaft 24, which supports the driving roller 15, and by mutually connecting the two toothed pulleys by means of a toothed belt 25.

For the sake of completeness in description, it should be noted that the shaft 24 is supported, so that it can rotate about its own axis, by the plate 9 by means of a pair of bearings 26*a* and 26*b*. Suitable yarn guides 27 can also be fixed to the plate 9 along the path followed by the yarn 5.

The cylindrical face of the rollers 3, 4, 15 and 16 is suitably covered with a material which adheres greatly to the yarn 5 to avoid undesirable slippages of the rollers on the yarn 5.

Operation of the device according to the present invention is as follows.

Various values of the tension of the elastic yarn, correlated to the various operating steps of the machine in the production of an item, are preset in the control and monitoring unit 8.

In practice, it is possible to correlate a given yarn tension to a given production step of the machine.

The yarn 5 arriving from the reel is passed through the rollers 15 and 16 and the rollers 3 and 4 and then passed through the corresponding yarn guide of the hosiery knitting machine.

While feeding the elastic yarn 5, the control and monitoring unit 8 drives the rollers 3 and 15 with a given rotation rate, which is correlated to the operating speed of the machine so as to obtain the intended tension for the elastic yarn 5.

At the exit of the positive feeder 2, the actual tension of the yarn 5 is detected by the detector means 7, which transmit the value of the detected tension to the control and monitoring unit 8, which compares it with the preset tension value provided for that specific production step of the machine. If the difference between the detected tension value and the preset tension value is within a given tolerance range, the control and monitoring unit 8 maintains the same actuation speed of the rollers 3 and 15; if the difference is outside the preset tolerance range, it varies the speed of the driving rollers 3 and 15 so as to return the difference between the detected value and the preset value within the preset tolerance range.

The detector means 21, arranged between the positive feeder 14 and the positive feeder 2, allow to detect yarn tension anomalies caused for example by different conditions of the unwinding of the yarn from the reel upstream of the positive feeder 2.

The detector means 21 send an electrical signal, which corresponds to the value of the tension of the yarn measured between the positive feeder 14 and the positive feeder 2, to the control and monitoring unit 8, which compares such tension with a preset value; if the difference between the detected value and the preset value is outside a preset tolerance range, it intervenes by varying the speed of the driving roller 3 and optionally of the driving roller 15, if the two driving rollers are actuated with two independent motors, or by simultaneously varying the rotation rate of the two driving rollers 3 and 15, in order to maintain the correct tension on the yarn 5 that exits from the positive feeder 2 despite said anomalies in the unwinding of the yarn.

It should be noted that the presence of the detector means 21 upstream of the positive feeder 2 allows to act in advance on the positive feeder 2 to prevent the anomaly in the tension of the yarn upstream of the positive feeder 2 from having an effect downstream of said positive feeder 2 and therefore from affecting the yarn tension in forming the item.

In this manner, by appropriately programming the control and monitoring unit 8, it is possible to obtain, according to requirements, items in which the tension of the elastic yarn being used remains constant throughout the manufacture of the item or is changed in the various regions of the item being formed according to the most disparate requirements.

Conveniently, the control and monitoring unit 8 is also suitable to detect the total number of turns of the electric motor 6 in order to consequently detect the total length of the yarn fed to the machine. This additional measurement performed by the control and monitoring unit 8 can be used for example, if the amount of yarn carried by a spool is known, to program the automatic stop of the machine at the end of this amount.

In practice it has been observed that the device according to the present invention fully achieves the intended aim and objects, since it is capable of ensuring high precision in feeding an elastic yarn to a hosiery knitting machine, allowing to produce items in which the tension of the elastic yarn can be varied with great precision according to requirements.

The device thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

What is claimed is:

1. A device for feeding an elastically extendable yarn to hosiery knitting machines, comprising:

at least one positive yarn feeder composed of two mutually opposite contrarotating rollers which have parallel axes, between which a yarn to be fed passes;

means for rotationally actuating at least one of said rollers about its own axis with a rotation rate which can vary on command;

detector means arranged downstream of said positive feeder along the yarn feed direction for detecting the tension of the yarn; and a programmable control and monitoring unit which is operatively connected to said detector means for comparing the tension of the yarn detected by said detector means with a first preset yarn tension which is preset in said control and monitoring unit, said control and monitoring unit being also operatively connected to said actuation means in order to vary the rotation rate of said at least one roller of the positive feeder in order to maintain within a preset tolerance range the difference between the detected yarn tension and the first preset yarn tension.

2. A device according to claim 1, wherein said actuation means comprise a variable-speed electric motor which is connected to said at least one roller.

3. A device according to claim 1, wherein said actuation means comprise an electric step motor which is connected to said at least one roller.

4. A device according to claim 1, wherein said actuation means comprise a brushless electric motor which is connected to said at least one roller.

5. A device according to claim 1, wherein said control and monitoring unit is constituted by a programmable microprocessor.

6. A device according to claim 1, wherein said control and monitoring unit is adapted to be connected to the hosiery knitting machine and wherein the yarn tensions that are preset in said control and monitoring unit are correlated to the production steps of the machine.

7. A device according to claim 1, comprising a first positive yarn feeder, and, upstream of said first positive yarn feeder along the yarn feed direction, a second positive yarn feeder which feeds the yarn to said first positive yarn feeder.

8. A device according to claim 7, wherein between said second positive yarn feeder and said first positive yarn feeder there are provided second means for detecting the tension of the yarn which are operatively connected to said programmable control and monitoring unit to compare the tension of the yarn, detected by said second detector means, with a second preset yarn tension which is preset in said control and monitoring unit, said control and monitoring unit being operatively connected to said second positive feeder in order to vary the speed at which the yarn is fed from said second positive feeder to said first positive yarn feeder and maintain within a preset tolerance range the difference between the yarn tension detected by said second detector means and the second preset tension.

9. A device according to claim 7, wherein said second positive feeder comprises two mutually opposite and contrarotating rollers which have parallel axes and between which the yarn to be fed passes, means being provided for rotationally actuating at least one of said rollers of said second positive feeder about its own axis and with a rotation rate that can be varied on command, said actuation means for said second positive feeder being driven by said control and monitoring unit.

10. A device according to claim 7, wherein said pair of rollers of at least one of said first and second positive feeders comprises a driving roller which is connected to the actuation means of the respective feeder and a presser roller which can rotate freely about its own axis and is pushed against said driving roller.

11. A device according to claim 10, wherein the driving roller of said first positive feeder is kinematically connected to the driving roller of said second positive feeder.

12. A device according to claim 10, wherein said presser roller has means for moving said presser roller on command towards or away from the corresponding driving roller.

13. A device according to claim 10, wherein said presser roller is mounted on an arm which can oscillate on command about an axis which is parallel to the axes of said rollers in order to vary the distance of said presser roller from the corresponding driving roller.

14. A device according to claim 8, wherein at least one of said detector means and said second detector means are constituted by a load cell.

15. A device according to claim 2, wherein said control and monitoring unit is connected to said variable-speed electric motor for detecting the total number of turns of said variable-speed electric motor in order to measure the length of the fed yarn.

* * * * *